US005903809A

United States Patent [19]

Tomatsu

[11] Patent Number: 5,903,809

[45] Date of Patent: May 11, 1999

[54] CLEANING ASSEMBLY FOR A FIXING DEVICE IN IMAGE FORMING APPARATUS

[75] Inventor: Yoshiya Tomatsu, Kasugai, Japan

[73] Assignee: Brother Kogyo Kabushiki Kaisha, Nagoya, Japan

[21] Appl. No.: 09/027,939

[22] Filed: Feb. 23, 1998

[30] Foreign Application Priority Data

Feb. 28, 1997 [JP] Japan ..... 9-45383

[51] Int. Cl.[6] ..... G03G 15/20

[52] U.S. Cl. ..... 399/327; 15/256.5; 399/324; 399/326

[58] Field of Search ..... 399/123, 324–327, 399/352, 350, 351; 15/256.5, 256.51, 256.52

[56] References Cited

U.S. PATENT DOCUMENTS

| | | | |
|---|---|---|---|
| 3,935,836 | 2/1976 | Bar-on | 399/351 |
| 4,258,648 | 3/1981 | Leising et al. | 399/325 |
| 4,803,752 | 2/1989 | Kasama | 399/351 |
| 5,138,391 | 8/1992 | Takahashi et al. | 399/327 |
| 5,420,678 | 5/1995 | Rasch et al. | 399/324 |

FOREIGN PATENT DOCUMENTS 2-34677 3/1990 Japan .

9-325659 12/1997 Japan .

*Primary Examiner*—Arthur T. Grimley
*Assistant Examiner*—Quana Grainger
*Attorney, Agent, or Firm*—Oliff & Berridge, PLC

[57] ABSTRACT

Wear of the surface of a heating roller caused by toner, paper powder and other like contaminants and a cleaning force are made uniform over a length of a heating roller by setting the press-contact force of a cleaning member with respect to each end portion of the heating roller smaller than the press-contact force at a portion other than the end portions on the basis of a tendency for the distribution of the toner, paper powder and the other like contaminants resulting from the rotation of the heating roller. Five attaching holes are formed at an upstream portion of a lower cover, defining the bottom of a fixing chamber in a fixing unit, lock members are not fitted into the two attaching holes corresponding to the end portions of the heating roller. Lock members are fitted into the other three attaching holes corresponding to the central portion of the heating roller in a state where a base end portion of the elastic spring member is inserted into the three attaching holes. Further, slits are formed at positions of the elastic spring member opposed to the end portions of the heating roller. Lastly, stopper projections are formed at the base end portion of the elastic spring member and the stopper grooves engaged with the stopper projections are formed at the lock members.

18 Claims, 5 Drawing Sheets

CLEANING ASSEMBLY FOR A FIXING DEVICE IN IMAGE FORMING APPARATUS

BACKGROUND OF THE INVENTION

1. Field of Invention

The invention relates to a fixing device in an image forming apparatus for fixing a toner image transcribed on paper by heating the paper transcribed with the image, which is formed by supplying a toner in accordance with an electrostatic latent image formed on a photosensitive drum in a developing device, by a heating roller. Particularly, the invention relates to a fixing device in which in bringing a cleaning member used for cleaning the heating roller into press contact with the heating roller, by setting a press-contact force of the cleaning member in respect of both end portions of the heating roller smaller than a press-contact force in respect of portions of the heating roller other than the both end portions, wear of the surface of the heating roller caused by toner, paper powder or other like contaminants and the cleaning force can be made uniform over the entire length of the heating roller.

2. Description of Related Art

There have conventionally been proposed various image forming devices, such as a laser printer or the like, adopting a so-called electronic photographing system. For example, an image forming device having a paper feeding device, a laser scanning device, a toner supplying device, a developing device, a fixing device and the like in gross classification, is disclosed in the specification and the drawings of Japanese Published Document No. 9-319201. According to such an image forming device, an electrostatic latent image is formed on the surface of a photosensitive drum in the developing device in accordance with image data presented using the laser scanning device, a toner image is formed on the photosensitive drum by supplying a toner, in accordance with the electrostatic latent image, from the toner supplying device, the toner image is transcribed by cooperation of a transcribing roller and the photosensitive drum onto a paper fed from the paper feeding device into the developing device and thereafter, the toner image is fixed by heating the paper by the fixing device.

In the fixing device, generally, a heating roller and a pressing roller, that is brought into press contact with the heating roller, are rotatably arranged. With respect to the surface of the heating roller, toner which is not fixed to the paper, paper powder generated from the paper and other like contaminants become adhered to the surface of the heating roller. A cleaning member composed of a felt member is brought into press contact with the surface of the heating roller to remove toner, paper powder and the other like contaminants adhered to the surface of the heating roller. The cleaning member is generally brought into press contact with the surface of the heating roller with a press-contact force which is uniform over the entire length of the heating roller.

In the meantime, generally, when toner, paper powder and the other like contaminants are adhered to various rollers, there is a tendency for the toner, paper powder and the other like contaminants to be aggregated at both end portions of the rollers in accordance with rotation of the rollers.

Under such conditions, when the cleaning member is brought into press contact with the heating roller with a press-contact force which is uniform over the entire length of the heating roller, as in the conventional fixing device, the toner, paper powder and the other like contaminants collected at the end portions of the heating roller operate as a polishing agent between the cleaning member and the heating roller whereby the end portions of the heating roller are polished. In this case, even at the central portion of the heating roller, the toner, paper powder and the other like contaminants operate as a polishing agent between the cleaning member and the heating roller and therefore, the central portion of the heating roller is also polished.

However, the amount of the toner, paper powder and the other like contaminants is larger at the end portions of the heating roller than at the central portion of the heating roller and accordingly, the amount of polishing of the heating roller caused by the toner, paper powder and the other like contaminants is larger at the end portions whereas it is smaller at the central portion. When the amount of polishing becomes nonuniform over the total length of the heating roller, there is the possibility of problems of an unequal fixing function caused by a nonuniformity of the fixing force in fixing the toner image formed on paper developing over time.

SUMMARY OF THE INVENTION

The invention resolves the problems and it is an object of the invention to set a press-contact force of a cleaning member of the end portions of a heating roller smaller than a press-contact force at other than the end portions of the heating roller in consideration of the distribution tendency of the toner, paper powder and the other like contaminants produced by the rotation of the heating roller. Further, it is an object of the invention to provide a fixing device for an image forming apparatus having a uniform wear of the surface of the heating roller caused by the toner, paper powder and the other like contaminants.

In order to achieve the above-described object, according to a first aspect of the invention, there is provided a fixing device of an image forming apparatus for forming a toner image on paper and fixing the toner image by heating the toner image, the fixing device including a rotatable heating roller and a pressing roller brought into press contact with the heating roller, a cleaning member extending in an axial direction of the heating roller and brought into contact with the heating roller, urging means for urging the cleaning member such that the cleaning member is brought into press contact with the heating roller, wherein the urging means urges the cleaning member such that a press-contact force exerted on both end portions of the heating roller via the cleaning member is smaller than a press-contact force exerted on a central portion of the heating roller.

According to the fixing device of the first aspect of the invention, when the cleaning member is brought into press contact with the heating roller via the urging means, the urging means urges the cleaning member such that the press-contact force exerted on the end portions of the heating roller by the cleaning member is smaller than the press-contact force exerted on the central portion of the heating roller. In this case, although the toner, paper powder and the other like contaminants are greater at the end portions and reduced at the central portion, because they collect at the end portions of the heating roller, the press-contact force of the cleaning member in respect of the heating roller is set such that it is smaller at the end portions and larger at the central portion and therefore, the amount of polishing of the end portions of the heating roller by the toner, paper powder and the other like contaminants, as a polishing agent, is substantially equal to the amount of polishing of the central portion. Thereby, the amount of wear of the surface of the heating roller caused by toner, paper powder and the other like contaminants and the cleaning force is uniform over the entire length of the heating roller and the fixing function is stabilized by making uniform the fixing force of the toner image.

Further, according to a second aspect of the invention, there is provided the fixing device in an image forming apparatus in accordance with the first aspect wherein the urging means comprises an elastic spring member, a base end portion of which is attached to a cover in a vicinity of the heating roller and which urges the cleaning member such that the cleaning member is brought into press contact with the heating roller. Further, according to a third aspect of the invention, there is provided the fixing device of an image forming apparatus in accordance with the second aspect wherein the cleaning member is fixed to a portion of the elastic spring member opposed to the heating roller. According to the fixing devices of the second aspect and the third aspect, the cleaning mechanism of the heating roller can be provided by a simple structure by fixing the cleaning member to the elastic spring member attached to the cover.

Further, according to a fourth aspect of the invention, there is provided the fixing device of an image forming apparatus in accordance with the second or the third aspect, further including a plurality of attaching holes which are formed in the cover over a longitudinal direction of the heating roller and into which a base end portion of the elastic spring member is inserted, lock members inserted into the attaching holes in a state where the base end portion of the elastic spring member is inserted into the attaching holes, wherein the lock members are inserted into the attaching holes at positions other than positions in correspondence with the end portions of the heating roller. According to the fourth aspect of the fixing device, the lock members are fitted into the attaching holes which are present at positions other than positions in correspondence with the end portions of the heating roller among the plurality of attaching holes by which the press-contact force of the cleaning member exerted on the end portions of the heating roller by the elastic force of the elastic spring member can be set smaller than the press-contact force exerted on the central portion. Further, the press-contact force of the cleaning member in respect of the heating roller can be adjusted flexibly by selecting the attaching holes into which the lock members are fitted.

Further, according to a fifth aspect of the invention, there is provided the fixing device of an image forming apparatus in accordance with any one of the second through the fourth aspects wherein slits are formed in the elastic spring member at positions in correspondence with the end portions of the heating roller. According to the fifth aspect of the fixing device, the slits are formed at positions of the elastic spring member in correspondence with the end portions of the heating roller and accordingly, the press-contact force exerted on the end portions of the heating roller via the cleaning member on the basis of the spring force of the elastic spring member can easily be reduced by the slits.

Further, according to a sixth aspect of the invention, there is provided the fixing device of an image forming apparatus in accordance with any one of the second through the fifth aspects wherein a stopper projection is formed at the base end portion of the elastic spring member and a stopper groove for engaging with the stopper projection is formed at each of the lock members. According to the sixth aspect of the fixing device, when the lock members are inserted into the attaching holes, the stopper projections of the elastic spring member are engaged with the stopper grooves of the lock members and therefore, the elastic spring member can firmly be held without varying the press-contact force of the cleaning member which is set such that it is smaller at the end portions of the heating roller than at the central portion.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
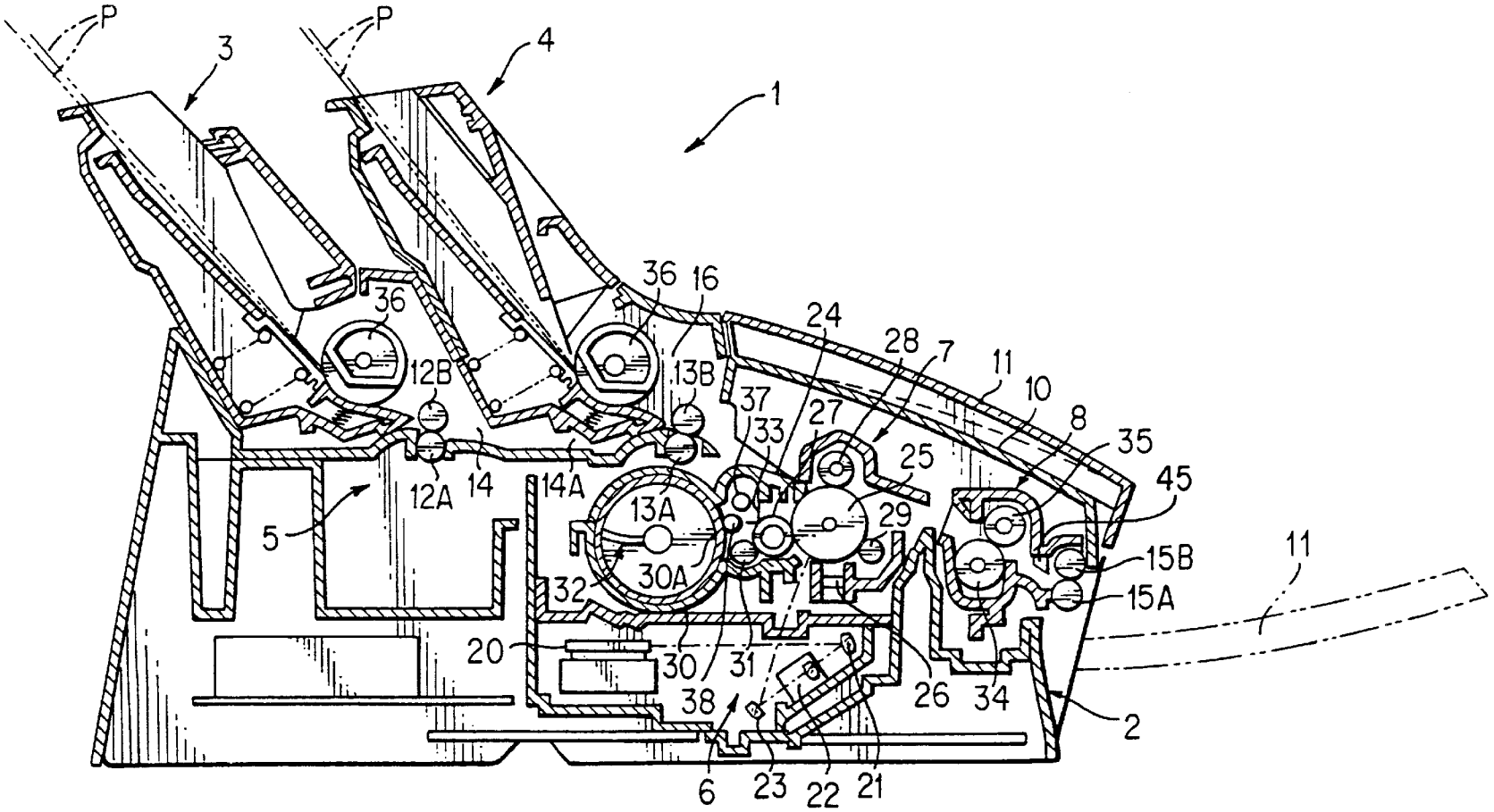
FIG. 1 is a side sectional view of a laser printer.

A detailed explanation will be given of a fixing device of an image forming apparatus according to the invention, based on embodiments implementing the invention using a laser printer, with reference to the drawings. Firstly, an explanation will be given of an outline structure of a laser printer according to the embodiment with reference to FIG. 1. FIG. 1 is a side sectional view of the exemplary laser printer in which the invention is used.

In FIG. 1, the laser printer 1 includes a main body case 2, a first paper feed tray 3 installed on the rear upper face side of the main body 2, a second paper feed tray 4, a paper feed mechanism 5 installed in the main body case 2, a scanner unit 6, a processing unit 7, a fixing unit 8, a drive unit (not illustrated, incorporated in a left end side portion of the main body case 2) for driving the paper feed mechanism 5 for the respective first and second paper feed trays 3, 4 and the like, and so on. A top cover 10 which can open the upper face side of a print mechanism portion and a paper discharge tray 11 are installed on the front upper face side of the main body case 2. The paper discharge tray 11 can be switched between a closed position and an open position and functions as a tray for receiving printed paper at the open position.

In this embodiment, the scanner unit 6, the processing unit 7, and the fixing unit 8 correspond to the print mechanism portion. The processing unit 7 is provided with a cartridge structure incorporating a photosensitive drum 25, an electrifier 26, a developing roller 27, a transcribing roller 28, and a cleaning roller 29 in a casing 24. The casing 24 is attachable and detachable to and from a predetermined position inside of the main body case 2.

The first paper feed tray 3 is fixedly provided at the upper face portion in the vicinity of a rear end portion of the main body case 2 and the second paper feed tray 4 is installed, attachably and detachably to and from the upper face portion, at the front side of the first feed paper tray 3 in the main body case 2. The paper feed mechanism 5 selectively feeds paper P from the first paper feed tray 3 and the second paper feed tray 4 to the processing unit 7. The paper feed mechanism 5 includes a pair of feed rollers 12A, 12B installed on the lower end side of the first paper feed tray 3 and a pair of resist rollers 13A, 13B installed on the lower end side of the second paper feed tray 4. The feed roller 12A is a driving roller and the feed roller 12B is a following roller. The resist roller 13A is a driving roller and the resist roller 13B is a following roller. A paper feed path 14 extending from the first paper feed tray 3 to the resist rollers 13A, 13B includes a lower face side feed path 14A extending along the lower face of the second paper feed tray 4. The lower face side feed path 14A is open when the second paper feed tray 4 is removed from the main body case 2.

The paper P is fed from first paper feed tray 3 via a pickup roller 36, reaches the resist rollers 13A, 13B via the lower face side feed path 14A by being fed by the pair of feed rollers 12A, 12B and is fed to the processing unit 7 by the resist rollers 13A, 13B. The paper P fed from the second paper feed tray 4 via a second pickup roller 36 reaches the resist rollers 13A, 13B and is fed to the processing unit 7.

The scanner unit 6 is arranged on the lower side of the processing unit 7 and is provided with a semiconductor laser (not illustrated), a polygonal mirror 20, reflecting mirrors 21, 23 and a lens 22. An electrostatic latent image is formed on the surface of the photosensitive drum 25 by irradiating and exposing by high-speed scanning of a laser beam, from the semiconductor laser, to an outer peripheral portion of the electrified rotating photosensitive drum 25 of the processing unit 7 via the polygonal mirror 20, the reflecting mirror 21, the lens 22 and the reflecting mirror 23 as shown by a single dot chain line in FIG. 1.

The processing unit 7 incorporates the photosensitive drum 25, the scorotron type electrifier 26, the developing roller 27, the transcribing roller 28, the cleaning roller 29, a toner box 30, and a toner supply roller 31 in the casing 24. The toner box 30 can be attached to and detached from the processing unit 7 in a state where the processing unit 7 is removed from the main body case 2. Toner in the toner box 30 is stirred by a stirrer 32, discharged from an opening 30A of the toner box 30 and, thereafter, supplied to the developing roller 27 via the toner supply roller 31, carried by the developing roller 27 as a toner layer having a constant thickness, provided by a blade 33, and is supplied to the photosensitive drum 25. Further, two auger members 37, 38 are rotatably arranged at positions in the vicinity of the opening 30A of the toner box 30 and the respective auger members 37, 38 operate to disperse uniformly the toner discharged from the opening 30A in the casing 24.

The electrostatic latent image formed on the surface of the photosensitive drum 25 is revealed by adhering the toner from the developing roller 27 and is transcribed onto the paper during a time period in which the paper P passes between the photosensitive drum 25 and the transcribing roller 28 and the paper P is then fed to the fixing unit 8 and is fixed. Incidentally, toner remaining on the surface of the photosensitive drum 25 is temporarily recovered by the cleaning roller 29 and is recovered by the developing roller 27 via the photosensitive drum 25 at predetermined timings.

The fixing unit 8 thermally fixes the toner on the paper and is provided with a heating roller 34, a pressing roller 35 which is brought into press contact with the heating roller 34 and a pair of discharge rollers 15A, 15B provided on the downstream side of the respective rollers 34, 35 for discharging the paper outside of the main body case 2.

Further, a feed speed whereby the paper P is fed via the photosensitive drum 25 and the transcribing roller 28 of the processing unit 7 is set to be equal to or greater than a feed speed whereby the paper P is fed via the heating roller 34, the pressing roller 35 and the respective discharge rollers 15A, 15B of the fixing unit 8. This is because when the feed speed by which the paper P is fed via the heating roller 34, the pressing roller 35 and the respective discharge rollers 15A, 15B is larger than the feed speed by which the paper P is fed via the photosensitive drum 25 and the transcribing roller 28, there is a concern that the paper P is pulled at a point where the toner image is transcribed from the photosensitive drum 25 onto the paper P, that is, at a nip point between the photosensitive drum 25 and the transcribing roller whereby the position of forming the image on the paper P is shifted and the image is disturbed.

Figure 2:
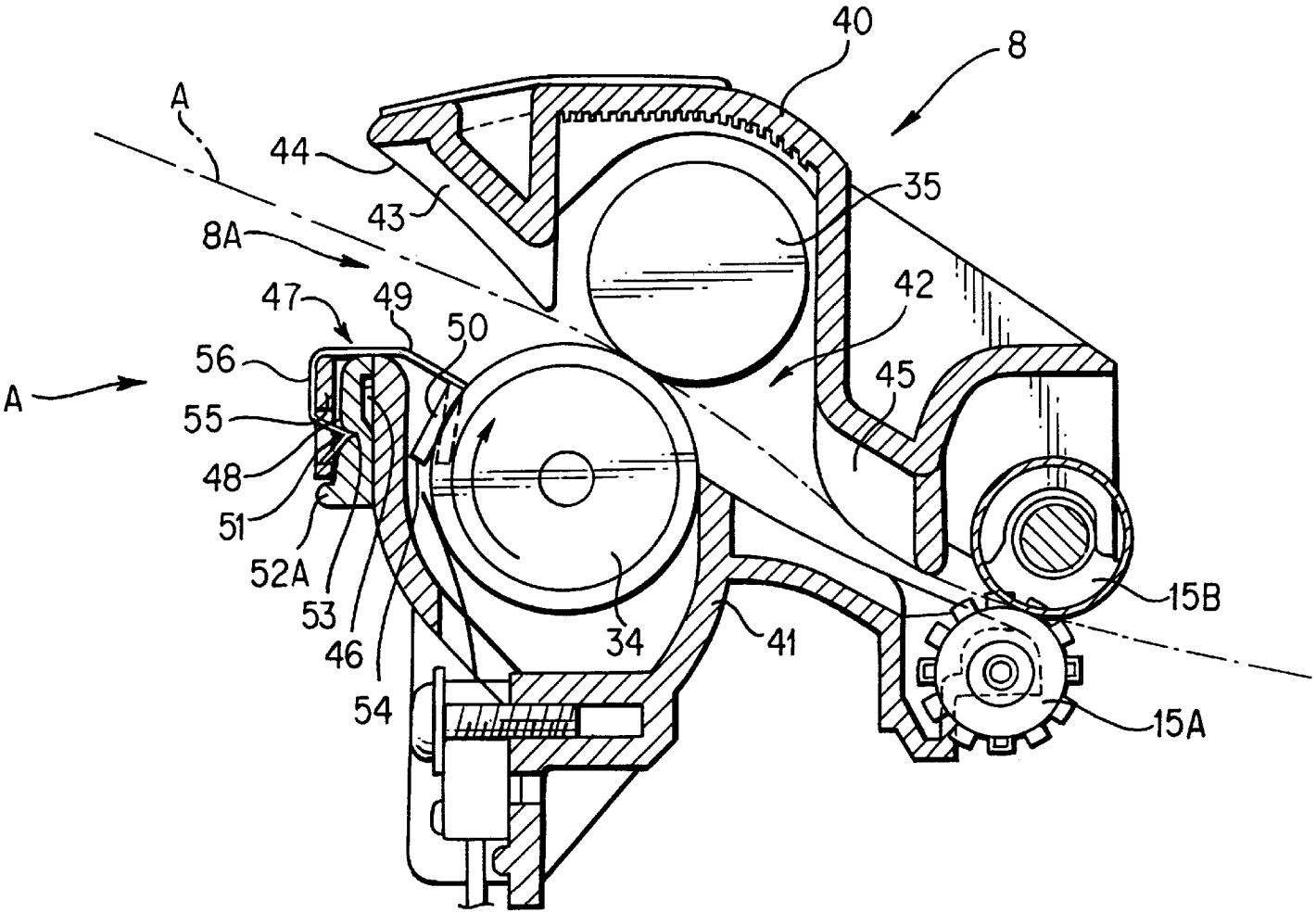
FIG. 2 is a side sectional view showing a fixing unit on an enlarged scale substantially along line 2—2 of FIG. 3.

Next, an explanation will be given of the detailed structure of the fixing unit 8 with reference to FIG. 2. FIG. 2 is a side sectional view showing an enlarged view of the fixing unit 8 of FIG. 1.

The fixing unit 8 is provided with an upper cover 40 and a lower cover 41. A fixing chamber 42 is defined between the upper cover 40 and the lower cover 41. The heating roller 34 is rotatably arranged at the lower portion of the fixing chamber 42. The pressing roller 35 is rotatably arranged at the upper portion and in pressing contact with the heating roller 34.

On the upstream side (with respect to the direction of feed of the paper P) of the fixing chamber 42, at the upper end portion (left end portion in FIG. 2) of the upper cover 40, a plurality of guide ribs 43 are arranged along the longitudinal axis of the heating roller 34 and extend in a direction parallel to a feed path A (indicated by two-dotted chain line) of the paper P. The guide ribs 43 are installed to smoothly guide the paper P, fed into a paper feed inlet 8A from the processing unit 7, into the fixing chamber 42. In order to facilitate the guiding operation, inclined faces 44 of the guide ribs 43 are gradually inclined toward the lower direction of the feed path A of the paper P. The lead edge of the paper P is first brought into contact with the inclined faces 44 of the guide ribs 43 and, thereafter, fed to a nip point between the pressing roller 35 and the heating roller 34 by being guided in the lower direction along the inclined faces 44.

Further, an anti-curl rib 45 is formed to extend from the inner upper wall of the upper cover 40 on the downstream side of the pressing roller 35 and the heating roller 34. The anti-curl rib 45 removes the curl placed in the paper P when the toner image on the paper P is heated and fixed by cooperation of the heating roller 34 and the pressing roller 35. Further, the pair of discharge rollers 15A, 15B for discharging the heated and fixed paper P to outside the printer are rotatably arranged on the downstream side of the fixing chamber 42.

Figure 2A:
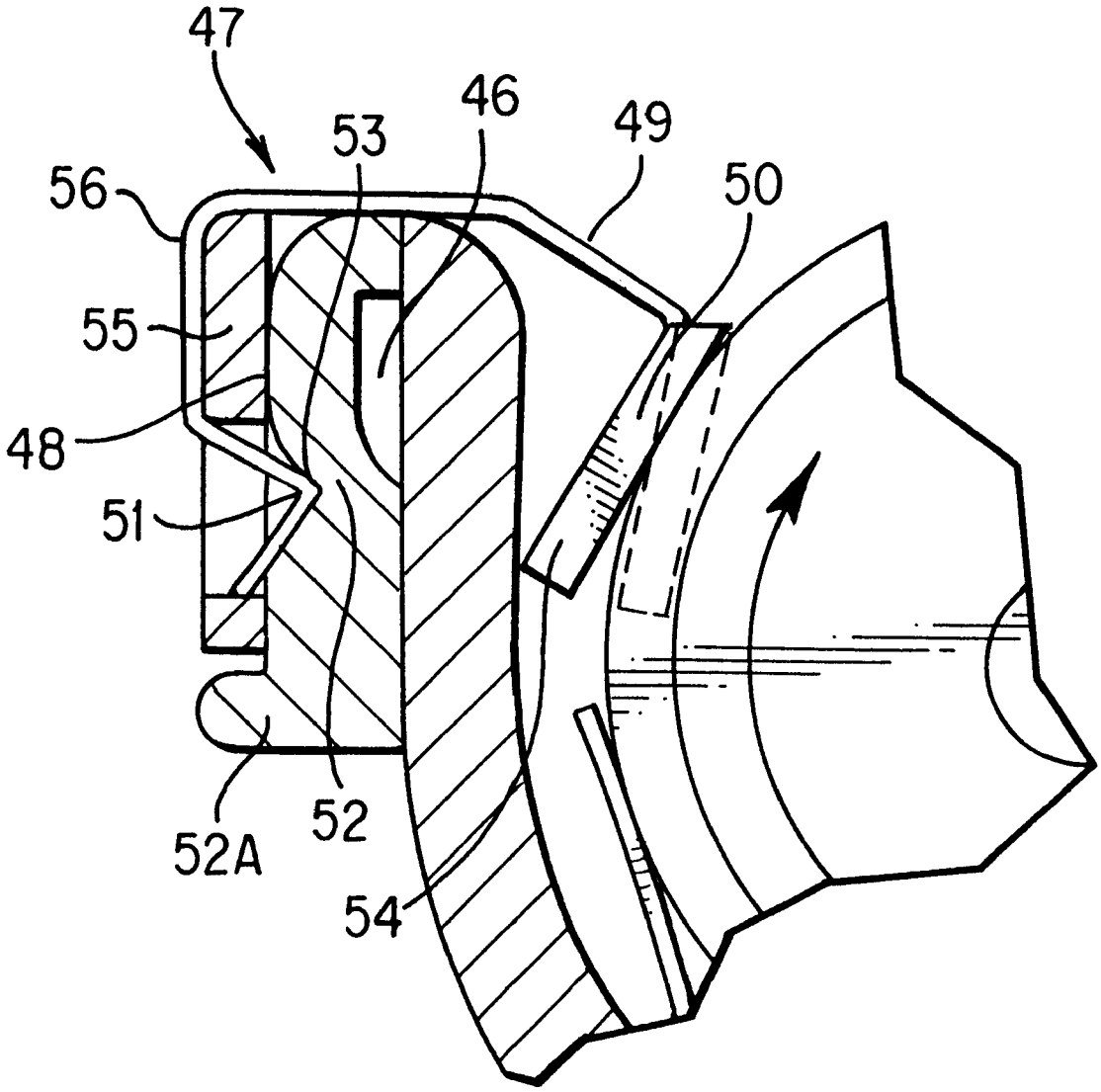
FIG. 2A is a further enlarged view of a cleaning unit mounted on a lower cover of the fixing unit.
Figure 3:
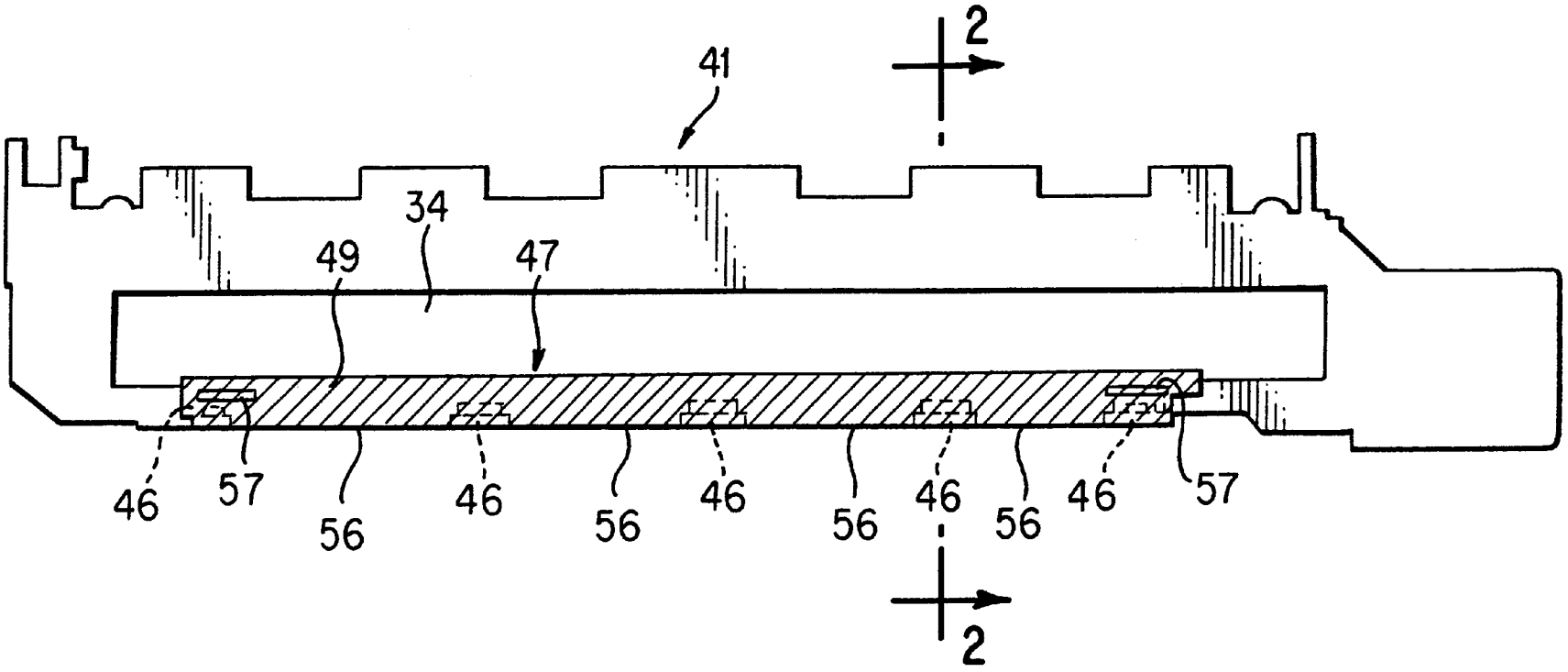
FIG. 3 is a plane view of a lower cover which is shown by removing an upper cover of the fixing unit.
Figure 4:
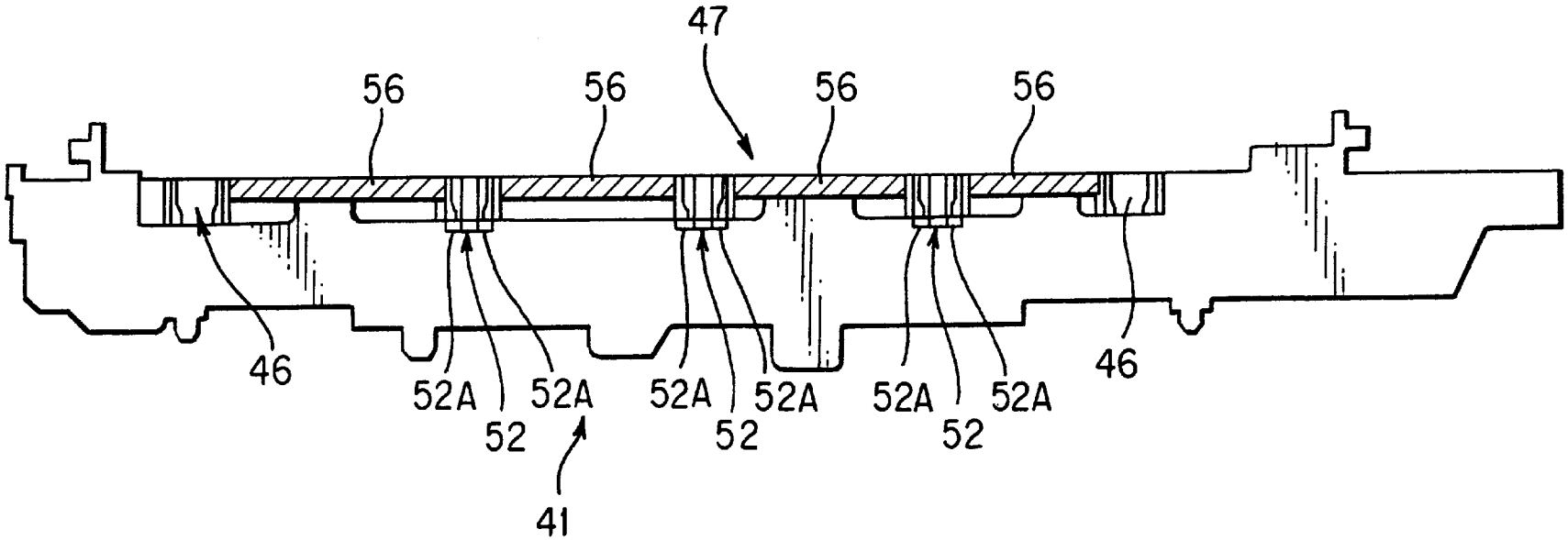
FIG. 4 is a side view, in the direction of Arrow A in FIG. 2, of the lower cover.

A plurality of attaching holes 46 which are open toward the lower direction (bottom of FIGS. 2 and 2A) are formed at the upstream end portion (left end portion in FIG. 2) of the lower cover 41. Further, as shown by FIGS. 3 and 4, according to the embodiment, five of the attaching holes 46 are formed. An elastic spring member 47 integrally formed from a metal thin plate is attached to the respective attaching holes 46. The elastic spring member 47 has a base end portion 48 formed at a position in correspondence with the respective attaching holes 46, an arm portion 49 formed continuously to the base end portion 48 and extended to the side of the fixing chamber 42 along the longitudinal axis of the heating roller 34, and a hold portion 50 bent from the arm portion 49 at a position in the vicinity of the heating roller 34. The elastic spring member 47 is positioned by inserting the respective base end portion 48 into the respective attaching holes 46.

The base end portion 48 is formed with a stopper projection 51. The stopper projection 51 is engaged with stopper grooves 53 of lock members 52, addressed below, when the lock members 52 are fitted into the attaching holes 46 for fixedly positioning the elastic spring member 47 to the lower cover 41 via the respective base end portion 48 and the attaching holes 46. Further, a cleaning member 54 made of felt is fixed to the face of the hold portion 50 opposed to the heating roller 34. The cleaning member 54 is brought into press contact with the surface of the heating roller 34 on the basis of the elastic force of the elastic spring member 47 and operates to clean toner, paper powder or the like adhered onto the surface of the heating roller 34 in accordance with rotation of heating roller 34 in the direction shown by the arrow. In this case, a press-contact force for bringing the cleaning member 54 into press contact with the both end portions of the heating roller 34 is set to be smaller than a press-contact force for bringing the cleaning member 54 in press contact with the central portion of the heating roller 34. An explanation will be given later of a specific method of adjustably setting the press-contact forces of the cleaning member 54 with respect of the heating roller 34. Further, as shown by FIGS. 2, 3 and 4, in the elastic spring member 47, stopper portions 56 stopped by an outer wail 55 at the upstream side end portion of the lower cover 41, are provided among the respective base end portions 48.

Further, the lock members 52 are each provided with a plate-like shape and selectively fitted into the attaching holes 46 from below. In this case, the lock member 52 is fitted to the attaching hole 46 in a state where the base end portion 48 of the elastic spring members 47 are fitted into the attaching holes 46 until a lower end projection 52A thereof is engaged with the lower end of the outer wall 55. At this point, the stopper projection 51 of the base end portion 48 is engaged with the engaging groove 53 by which the lock members 52 are fixed into the attaching holes 46. In this way, the elastic spring member 47 is positioned and fixed to the lower cover 41.

Next, an explanation will be given of a specific method of adjustably setting the press-contact force of the cleaning member 54 with respect to the heating roller 34 such that the press-contact force is reduced at both end portions of the heating roller 34 and is increased at the central position with reference to FIGS. 3 and 4. FIG. 3 is a plan view of the lower cover 41 that is shown by removing the upper cover 40 of the fixing unit 8 and FIG. 4 is a side view of the lower cover 41 shown in a state where top and bottom of the lower cover 41 is reversed.

In FIGS. 3 and 4, the lock members 52 are not fitted into two of the attaching holes 46 corresponding to end portions of the heating roller 34 of the five attaching holes 46 formed in the lower cover 41. The lock members 52 are fitted into the three remaining attaching holes 46 which correspond to the central portion of the heating roller 34. In this state, the elastic spring member 47 is solidly fixed to the lower cover 41 at a portion corresponding to the central portion of the heating roller 34 whereas the fixing force of the elastic spring member 47 with respect to the lower cover 41 is reduced at portions corresponding to the end portions of the heating roller 34. The press-contact force of the cleaning member 54 fixed to the hold portion 50 of the elastic spring member 47 at the end portions of the heating roller 34 is smaller than the press-contact force at the central portion of the heating roller 34.

Further, slits 57 are formed at positions of the elastic spring member 47 opposed to the end portions of the heating roller 34 as shown in FIG. 3. The respective slits 57 operate to weaken the elastic force of the elastic spring member 47 and therefore, in addition to the fact that a lock member 52 is not fitted into the respective attaching holes 46 in correspondence with the end portions of the heating roller 34, the press-contact force of the cleaning member 54 of the hold portion 50 with respect to the end portions of the heating roller 34 is weakened.

An explanation of the operation of the laser printer 1 structure as described above will be given.

The paper P fed from the first paper feed tray 3 or the second paper feed tray 4 is fed into the processing unit 7 via the feed rollers 12A, 12B and/or the resist rollers 13A, 13B. Further, in the processing unit 7, toner is supplied from the toner box 30 to the electrostatic latent image formed on the photosensitive drum 25 by the scanner unit 6, based on image data, via the toner supply roller 31 and the developing roller 27. In this way, a toner image is formed on the surface of the photosensitive drum 25.

Further, paper P fed into the processing unit 7 is transported while being nipped between the photosensitive drum 25 and the transcribing roller 28, and the toner image on the photosensitive drum 25 is transcribed onto the image forming face (lower face) of the paper P while being fed in this way and the paper is transported to the downstream side along the feed path A.

At this moment, the feed speed by which the paper P is fed via the photosensitive drum 25 and the transcribing roller 28 of the processing unit 7 is set to be equal to or greater than the feed speed by which the paper P is fed via the heating roller 34, the pressing roller 35 and the discharge rollers 15A, 15B of the fixing unit 8. Based on this setting, the lead edge of the paper P comes into contact with the lower face of a cover of the processing unit 7.

Thereafter, the lead edge of the paper P contacts the inclined faces 44 of the guide ribs 43 formed on the paper cover 40 of the fixing chamber 42 and is nipped between the heating roller 34 and the pressing roller 35 after being guided downwardly along the inclined faces 44. The toner image transcribed onto the paper P is then heated and fixed by cooperation of the heating roller 34 and the pressing roller 35, and thereafter, the paper P is discharged outside via the discharge rollers 15A, 15B.

During the time period for carrying out such a printing operation, toner, paper powder and the other like contaminants created in the printing operation adhere onto the surface of the heating roller 34 and further, the toner, paper powder and the other like contaminants tend to collect at the end portions of the heating roller 34 in accordance with rotation of the heating roller 34. As a result, toner, paper powder and the other like contaminants on the surface of the heating roller 34 increase at the end portions of the heating roller 34 whereas they are reduced at the central portion.

The toner, paper powder and the other like contaminants adhered onto the surface of the heating roller 34 are cleaned by being scraped off by the cleaning member 54 fixed to the hold portion 50 of the elastic spring member 47. In this case, even when the toner, paper powder and the other like contaminants at the surface of the heating roller 34 are increased at the end portions of the heating roller 34 and reduced at the central portion, the press-contact force of the cleaning member 54, fixed to the hold portion 50 of the elastic spring member 47, at the end portions of the heating roller 34 is made smaller than the press-contact force at the central portion of the heating roller 34. Therefore, the amount of polishing of the end portions of the heating roller 34 by the toner and paper powder is substantially equal to the amount of polishing of the central portion. Thereby, the amount of wear of the surface of the heating roller 34 caused by the toner, paper powder and the other like contaminants and the cleaning force can be made uniform over the total length of the heating roller and the fixing function can be stabilized by making uniform the fixing force of the toner image.

Further, the slits 57 are formed at positions opposed to the end portions of the heating roller 34 and therefore, in addition to the fact that a lock member 52 is not used in the respective attaching holes 46 corresponding to the end portions of the heating roller 34, the press-contact force of the cleaning member 54 of the hold portion 50 at the end portions of the heating roller 34 can be adjusted to be even weaker, by which the press-contact force of the cleaning member 54 to the heating roller 34 can be adjusted flexibly in correspondence with the nonuniform distribution of the toner, paper powder and the other like contaminants on the surface of the heating roller 34.

As has been explained in detail, according to the exemplary laser printer 1 of the embodiment, the five attaching holes 46 are formed on the upstream end portion of the lower cover 41, lock members 52 are not fitted into the two attaching holes 46 opposing the end portions of the heating roller 34, from among all of the attaching holes 46, and the lock members 52 are fitted into the remaining attaching holes 46 that correspond to the central portion of the heating roller 34 where the base end portions 48 of the elastic spring member 47 are inserted. Therefore, the elastic spring member 47 is solidly fixed to the lower cover 41 at a portion corresponding to the central portion of the heating roller 34 whereas the fixing force of the elastic spring member 47 with respect to the lower cover 41 is reduced at portions corresponding to the end portions of the heating roller 34, and the press-contact force of the cleaning member 54 fixed to the hold portion 50 of the elastic spring member 47 at the end portions of the heating roller 34 can be made smaller than the press-contact force at the central portion of the heating roller 34.

Thereby, even when the toner, paper powder and the other like contaminants on the surface of the heating roller 34 is increased at the end portions of the heating roller 34 and reduced at the central portion, the amount of polishing of the end portions of the heating roller 34 by the toner, paper powder and the other like contaminants can be made substantially equal to the amount of polishing of the central portion. Accordingly, the amount of wear of the surface of the heating roller caused by the toner, paper powder and the other like contaminants and the cleaning force can be made uniform over the total length of the heating roller and the fixing function can be stabilized by making uniform the fixing force of the toner image.

Further, the slits 57 are formed at positions opposed to the end portions of the heating roller 34 and accordingly, in addition to the fact that the lock members 52 are not fitted into the respective attaching holes 46 opposing the end portions of the heating roller 34, the press-contact force of the cleaning member 54 of the hold portion 50 at the end portions of the heating roller 34 can be adjusted to be further weakened, by which the press-contact force of the cleaning member 54 in respect of the heating roller 34 can be adjusted flexibly in correspondence with the nonuniform distribution of the toner, paper powder and the other like contaminants on the surface of the heating roller 34.

Further, the stopper projection 51 is formed at the base end portion 48 of the elastic spring member 47 and the stopper groove 53, engaging with the stopper projection 51, is formed in the lock member 52. Accordingly, when a lock member 52 is fitted into an attaching hole 46, the lock member 52 engages the stopper projection 51 of the base end portion 48 having the stopper groove 53 and is fixed. As a result, the cleaning member 54 can firmly be held without varying the press-contact force of the cleaning member 54 which is set such that it is smaller at the end portions than at the central portion of the heating roller 34 as described above.

The invention is not limited to the above-described embodiments but various improvements and modifications can naturally be carried out within the scope of the invention as embodied in the following claims.

What is claimed is:

1. A fixing device of an image forming apparatus for forming a toner image on paper and fixing the toner image by heating the toner image, the fixing device comprising:

a rotatable heating roller and a pressing roller brought into press contact with the heating roller;

a cleaning member extending in an axial direction of the heating roller and brought into contact with the heating roller;

a press contact member that applies a first press-contact force to each end of the cleaning member against the heating roller and a second press-contact force to a central portion of the cleaning member against the heating roller, the press contact member comprising an elastic spring member, a base end portion of the elastic spring member attached to a cover adjacent the heating roller, the elastic spring member urging the cleaning member such that the cleaning member is brought into press contact with the heating roller, the cover has a plurality of attaching holes arrayed over a length direction of the heating roller and into which the base end portion of the elastic spring member is inserted; and lock members inserted into the attaching holes in a state where the base end portion of the elastic spring member is inserted into the attaching holes, wherein the lock members are inserted into the attaching holes at positions other than positions in correspondence with the each end portion of said heating roller.

2. The fixing device according to claim 1, wherein the first press-contact force is less than the second press-contact force.

3. The fixing device of an image forming apparatus according to claim 1, wherein the cleaning member is fixed to a portion of the elastic spring member opposed to the heating roller.

4. The fixing device of an image forming apparatus according to claim 3 wherein slits are formed in the elastic spring member at positions in correspondence with the each end portion of the heating roller.

5. The fixing device of an image forming apparatus according to claim 1, wherein a stopper projection is formed at the base end portion of the elastic spring member and a stopper groove for engaging with the stopper projection is formed at each of the lock members.

6. The fixing device of an image forming apparatus according to claim 1, wherein slits are formed in the elastic spring member at positions in correspondence with the each end portion of the heating roller.

7. The fixing device of an image forming apparatus for forming a toner image on paper and fixing the toner image by heating the toner image, the fixing device comprising:

a rotatable heating roller and pressing roller brought into press contact with the heating roller;

a cleaning member extending in an axial direction of the heating roller and brought into contact with the heating roller; and a press contact member that applies a first press-contact force to each end of the cleaning member against the heating roller and a second press-contact force to a central portion of the clinging member against the heating roller, the press contact member comprising an elastic spring member, a base end portion of the elastic spring member attached to a cover adjacent to heating roller, the elastic spring member urging the cleaning member such that the cleaning member is brought into press contact with the heating roller, wherein slits are formed in the elastic spring member at positions in correspondence with the each end portion of the heating roller.

8. The fixing device of an image forming apparatus according to claim 7, further comprising:

a plurality of attaching holes which are formed in the cover arrayed over a length direction of the heating roller and into which the base end portion of the elastic spring member is inserted;

lock members inserted into the attaching holes in a state where the base end portion of the elastic spring member is inserted into the attaching holes, wherein the lock members are inserted into the attaching holes at positions other than positions in correspondence with the each end portion of said heating roller.

9. The fixing device of an image forming apparatus according to claim 8, wherein a stopper projection is formed at the base end portion of the elastic spring member and a stopper groove for engaging with the stopper projection is formed at each of the lock members.

10. The fixing device of an image forming apparatus according to claim 7, wherein a stopper projection is formed at the base end portion of the elastic spring member and a stopper groove for engaging with the stopper projection is formed at each of the lock members.

11. A heating roller, for a fixing unit of a print apparatus, cleaning device, comprising:

a lower cover forming a base for the fixing unit containing the heating roller, the lower cover having an upstream wall, relative to a direction of print medium feed, adjacent the heating roller;

an elastic spring member mounted to the upstream wall and having an arm portion extending toward the heating roller and a holding portion opposing the heating roller; and a cleaning member mounted to the holding portion in contact with the heating roller, wherein the elastic spring member extends the length of the heating roller and is mounted to the upstream wall only at a position corresponding to a center portion of the heating roller to apply a greater contact pressure of the cleaning member at the center portion of the beating roller than at end portions of the heating roller.

12. The heating roller cleaning device according to claim 11, wherein the elastic spring is fixedly mounted at three points on the upstream wall.

13. The heating roller cleaning device according to claim 12, wherein the elastic spring portion has a slit in a portion opposing each end of the heating roller to permit flexing of each end of the cleaning member.

14. The heating roller cleaning device according to claim 11, wherein the elastic spring portion has a slit in a portion opposing each end of the heating roller to permit flexing of each end of the cleaning member.

15. The heating roller cleaning device according to claim 11, wherein the upstream wall has five mounting points and the elastic spring member is fixedly mounted at three of the mounting points corresponding to the center portion of the heating roller.

16. The heating roller cleaning device according to claim 15, wherein a mounting point is positioned to correspond to each end of the heating roller and the elastic spring member is resiliently mounted to each said end mounting point to apply a reduced cleaning force to the heating roller.

17. The heating roller cleaning device according to claim 16, wherein the elastic spring portion has a slit in a portion opposing each end of the heating roller to permit flexing of each end of the cleaning member.

18. The heating roller cleaning device according to claim 15, wherein the mounting points are attaching holes formed in the upstream wall, the elastic spring member has a stopper projection inserted into each attaching hole, and the cleaning device farther comprises a lock member for fixing the stopper projection in the center three attaching holes.

* * * * *